US006863645B2

(12) United States Patent
Crunkleton et al.

(10) Patent No.: US 6,863,645 B2
(45) Date of Patent: Mar. 8, 2005

(54) METHOD AND APPARATUS FOR INSERTING SLIDERS DURING AUTOMATED MANUFACTURE OF RECLOSABLE BAGS

(75) Inventors: Gregory H. Crunkleton, Nicolson, GA (US); Basil C. Linton, Loganville, GA (US); Eric J. Fenzl, Loganville, GA (US); Charles Shultz, Canton, GA (US); Ronald Cortigiano, Sr., Toccoa, GA (US); Robert E. Hogan, Burr Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/436,433

(22) Filed: May 12, 2003

(65) Prior Publication Data

US 2004/0229740 A1 Nov. 18, 2004

(51) Int. Cl.[7] ..... B31B 1/90
(52) U.S. Cl. ..... 493/212; 493/213
(58) Field of Search ..... 493/212–214; 53/133.4, 139.2

(56) References Cited

U.S. PATENT DOCUMENTS

| | | | | | |
|---|---|---|---|---|---|
| 3,426,396 | A | | 2/1969 | Laguerre | 24/201 |
| 3,713,923 | A | | 1/1973 | Laguerre | 156/66 |
| 3,790,992 | A | | 2/1974 | Herz | 24/201 |
| 5,304,056 | A | * | 4/1994 | Fetterhoff | 425/304 |
| 5,322,579 | A | * | 6/1994 | Van Erden | 156/66 |
| 5,983,466 | A | * | 11/1999 | Petkovsek | 24/400 |
| 6,044,621 | A | * | 4/2000 | Malin et al. | 53/412 |
| 6,088,887 | A | | 7/2000 | Bois | 24/399 |
| 6,131,369 | A | * | 10/2000 | Ausnit | 53/412 |
| 6,161,271 | A | * | 12/2000 | Schreiter | 29/408 |
| 6,244,021 | B1 | * | 6/2001 | Ausnit et al. | 53/412 |
| 6,264,366 | B1 | | 7/2001 | Custer | 383/5 |
| 6,286,189 | B1 | | 9/2001 | Provan et al. | 24/30.5 R |
| 6,286,999 | B1 | | 9/2001 | Cappel et al. | 383/5 |
| 6,477,821 | B1 | | 11/2002 | Bois | 53/412 |
| 6,517,473 | B1 | * | 2/2003 | Cappel | 493/213 |
| 6,526,726 | B1 | * | 3/2003 | Strand et al. | 53/412 |
| 6,599,227 | B1 | * | 7/2003 | Kettner | 493/394 |
| 6,666,626 | B2 | * | 12/2003 | McMahon et al. | 406/50 |
| 2002/0034341 | A1 | | 3/2002 | Bois | 383/59 |

FOREIGN PATENT DOCUMENTS

GB 2366596 A 3/2002

* cited by examiner

*Primary Examiner*—Eugene Kim
(74) *Attorney, Agent, or Firm*—Ostrager Chong Flaherty & Broitman P.C.

(57) ABSTRACT

Methods and apparatus for low-cost manufacture of reclosable packages having slider-operated zippers. One method of manufacture comprising the following steps: (a) joining film material to a back side of a first flangeless zipper strip having a first closure profile on its front side; (b) joining film material to a back side of a second flangeless zipper strip having a second closure profile on its front side, the first and second closure profiles of the first and second zipper strips being interlockable to form a string zipper assembly; and (c) loading a slider comprising a plow onto an open section of the string zipper assembly with the plow being inserted between the first and second flangeless zipper strips. Respective portions of the first and second portions of film are respectively disposed between the slider and the string zipper assembly when the slider is loaded. This method further comprises the step of trimming a marginal portion of the film material that extends beyond the portion of film material joined to the back side of either of the first flangeless zipper strip.

15 Claims, 9 Drawing Sheets

METHOD AND APPARATUS FOR INSERTING SLIDERS DURING AUTOMATED MANUFACTURE OF RECLOSABLE BAGS

BACKGROUND OF THE INVENTION

This invention generally relates to methods and apparatus for inserting sliders onto zippers for use in reclosable packaging, such as zippered bags or pouches. In particular, the invention relates to slider insertion devices incorporated in machines for making reclosable packages having slider-operated string zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Previous slider-operated, separately extruded zippers used flange-type constructions.

An alternative zipper design is the so-called flangeless or string zipper, which has no flange portion above or below the interlockable closure profiles. In the case of a string zipper, the bag making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

U.S. patent application Ser. No. 10/367,450 discloses a reclosable bag in which respective marginal portions of the bag film are sealed to the back sides of respective flangeless zipper strips and in which the resulting string zipper is actuated by means of a straddling-type slider having a plow that separates the zipper strips during opening.

There is a need for methods and apparatus for low-cost manufacture of reclosable packages having slider-operated string zippers.

BRIEF DESCRIPTION OF THE INVENTION

The present invention is particularly directed to methods and apparatus for low-cost manufacture of reclosable bags having slider-operated string zippers. However, some aspects of the invention disclosed herein could also be used in the manufacture of reclosable slider bags having flanged zipper strips.

One aspect of the invention is a method of manufacture comprising the following steps: (a) joining a first portion of a length of film material to a back side of a length of a first flangeless zipper strip having a first closure profile on its front side; (b) joining a second portion of the length of film material to a back side of a length of a second flangeless zipper strip having a second closure profile on its front side, the first and second closure profiles of the respective lengths of the first and second zipper strips being interlockable to form a length of string zipper assembly; and (c) after the joining steps, loading a slider comprising a plow onto a section of the length of string zipper assembly with the plow being inserted between the flangeless zipper strips, respective portions of the first and second portions of the length of film material being respectively disposed between the slider and the string zipper assembly after the slider has been loaded.

Another aspect of the invention is a method of manufacture comprising the following steps: (a) joining a first portion of a length of film material to a length of a first zipper strip having a first closure profile; (b) joining a second portion of the length of film material to a length of a second zipper strip having a second closure profile, the first and second closure profiles of the respective lengths of the first and second zipper strips being interlockable to form a length of zipper assembly; (c) inserting a retractable plate between the first and second zipper strips in a first section of the length of zipper assembly; and (d) after steps (a) through (c) have been performed, loading a slider comprising a plow onto a second section of the length of zipper assembly with the plow being inserted between the first and second zipper strips. The first and second sections do not overlap.

A further aspect of the invention is a method of manufacture comprising the following steps: (a) joining a first portion of a length of film material to a length of a first zipper strip having a first closure profile; (b) joining a second portion of the length of film material to a length of a second zipper strip having a second closure profile, the first and second closure profiles of the respective lengths of the first and second zipper strips being interlockable to form a length of zipper assembly; (c) inserting a retractable plate between the first and second zipper strips in a first section of the length of zipper assembly; and (d) maintaining second and third sections of the length of zipper assembly in an open state while the slider is being loading onto the first section. The second and third sections are located on opposite sides of the first section.

Yet another aspect of the invention is an apparatus comprising: a first assembly that maintains respective first sections of first and second zipper strips of a zipper assembly in an open state; a second assembly that maintains respective second sections of the first and second zipper strips in an open state; and a pusher assembly comprising a pusher that is movable from a retracted position to an extended position for inserting a slider onto the first and second zipper strips in a zone disposed between the first and second sections. The pusher assembly is generally disposed between the first and second assemblies, while the second assembly comprises retractable components that can be retracted to allow the slider to pass through when the zipper assembly is advanced.

Another aspect of the invention is an apparatus comprising: a pusher movable from a retracted position to an extended position for inserting a slider onto a first open section of a zipper assembly comprising first and second zipper strips; a plate movable from a retracted position to an extended position, the plate in the extended position having a portion disposed between the first and second zipper strips along a second open section of the zipper assembly proximal to the first open section; and first and second clamps movable in generally opposite directions from respective retracted positions to respective extended positions, the zipper assembly being clamped to the plate by the first and second clamps in their extended positions. The plate and clamps provide clearance for the slider to pass through when in their respective retracted positions. In their extended positions, the clamps clamp the second open section of the zipper assembly against the plate.

A further aspect of the invention is a machine comprising: means for joining film material to a first zipper strip having a first closure profile; means for joining film material to a second zipper strip having a second closure profile, the first and second closure profiles of the first and second zipper strips being interlockable to form a zipper assembly, and the zipper assembly and the film material forming a zipper-film assembly when joined; means for loading a slider comprising a plow onto a first section of the zipper-film assembly with the plow being inserted between the first and second zipper strips; and first and second members for respectively maintaining second and third sections of the zipper assembly in an open state while the slider is being loading onto the first section. The second and third sections are located on opposite sides of the first section. The second member is movable between a retracted position and an extended position, a portion of the second member being interposed between the first and second zipper strips in the extended position but not in the retracted position.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
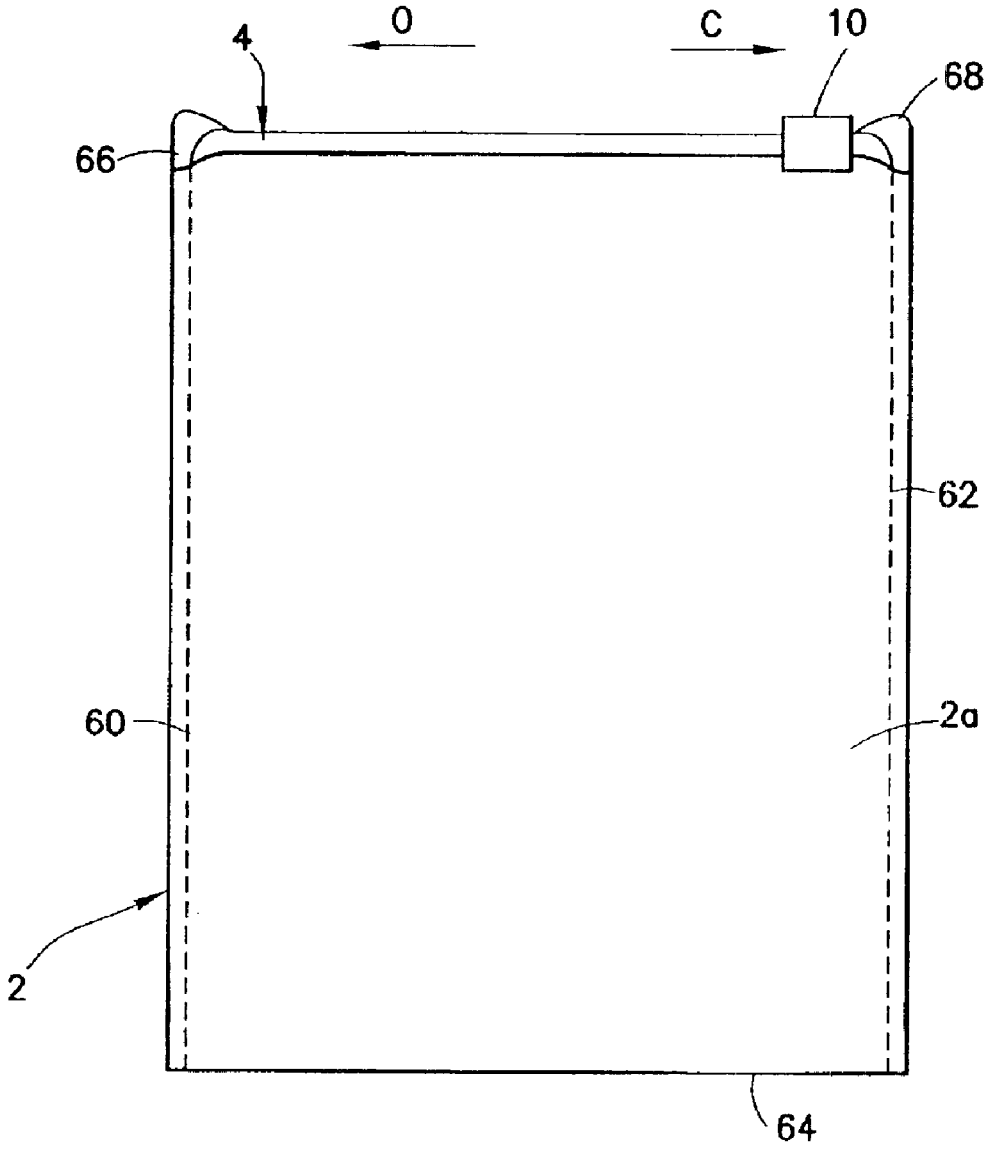
FIG. 1 is a drawing showing a reclosable package having a slider-operated zipper with end stops.

A reclosable package or bag comprising a receptacle 2 and a flexible plastic string zipper 4, operated by manipulation of a slider 10, is shown in FIG. 1, adapted from U.S. patent application Ser. No. 10/367,450. The present invention is directed to methods and apparatus for making reclosable bags of the type shown in FIG. 1 as well as other types of reclosable packages having different structures. Although the methods and apparatus disclosed herein were designed with slider-operated string zipper bags in mind, some aspects of the invention also have application in slider-operated reclosable bags comprising flanged zipper strips.

Referring to FIG. 1, the receptacle 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The receptacle 2 comprises opposing walls (only the front wall 2*a* is visible in FIG. 1) that may be secured together at opposite side edges of the bag by seams 60 and 62 (indicated by dashed lines). The opposing bottoms of the walls may be joined, for example, by means of a heat seal made in conventional fashion, e.g., by application of heat and pressure. Typically, however, the bottom of the package is formed by a fold 64 in the original packaging film, as depicted in FIG. 1.

Figure 2:
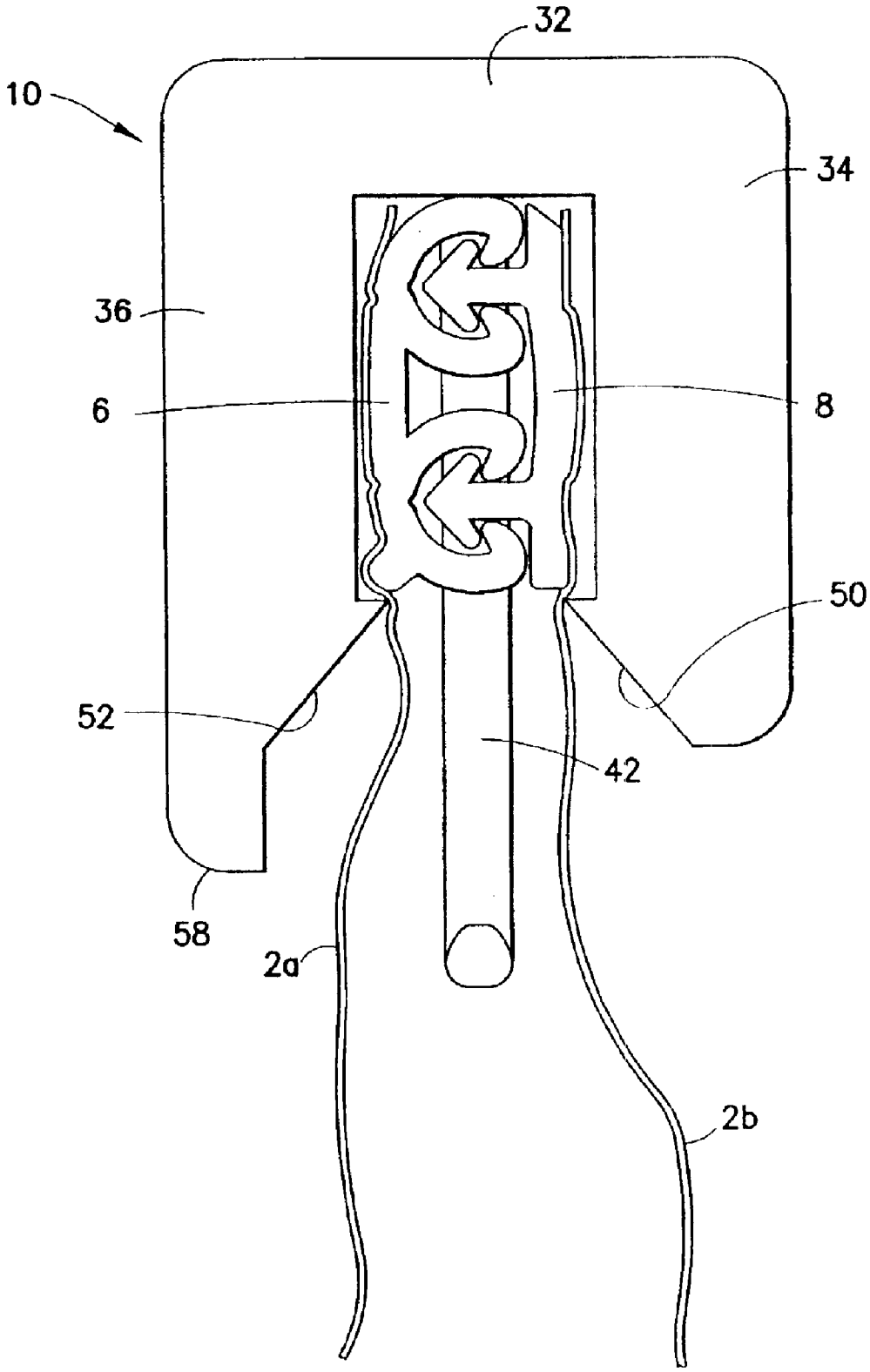
FIG. 2 is a drawing showing a partially sectioned view of a slider-string zipper assembly. The zipper is shown sectioned in a plane in front of the closing end of the slider.

At its top end, the receptacle 2 has an openable mouth, on the inside of which is an extruded plastic string zipper 4. The string zipper 4 comprises a pair of interlockable zipper parts or closure strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The top edges of the front and rear walls 2*a* and 2*b* (see FIG. 2) are respectively sealed to the backs of the zipper halves 6 and 8 by a conventional conduction heat sealing technique.

The string zipper is operated by sliding the slider 10 along the zipper parts. As the slider moves across the zipper, the zipper is opened or closed. As shown in FIG. 1, the slider is slidable along the zipper in a closing direction "C", causing the zipper halves to become engaged, or in an opening direction "O", causing the zipper halves to become disengaged.

The bag shown in FIG. 1 further comprises end stops 66 and 68 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S. patent application Ser. No. 10/113,489, entitled "Method and Apparatus for Ultrasonically Stomping Slider End Stops on Zipper". The horn and anvil of the ultrasonic welding apparatus disclosed therein are specifically designed so that the ultrasonic stomping operation create a vertical hump on the zipper to stop the slider, while at the same time preserving the base of the zipper profile to resist pull-off of the slider. Sufficient heat penetrates into the mass of the zipper profile in the end stop areas to fuse the zipper parts together, posing an obstacle to the slider plow. Also, a V-shaped notch can be formed in one end or both ends of the slider top wall for receiving the vertical hump of respective formed end stops. This allows the plow to abut against the fused end of the zipper in the zipper fully closed state.

Figure 3:
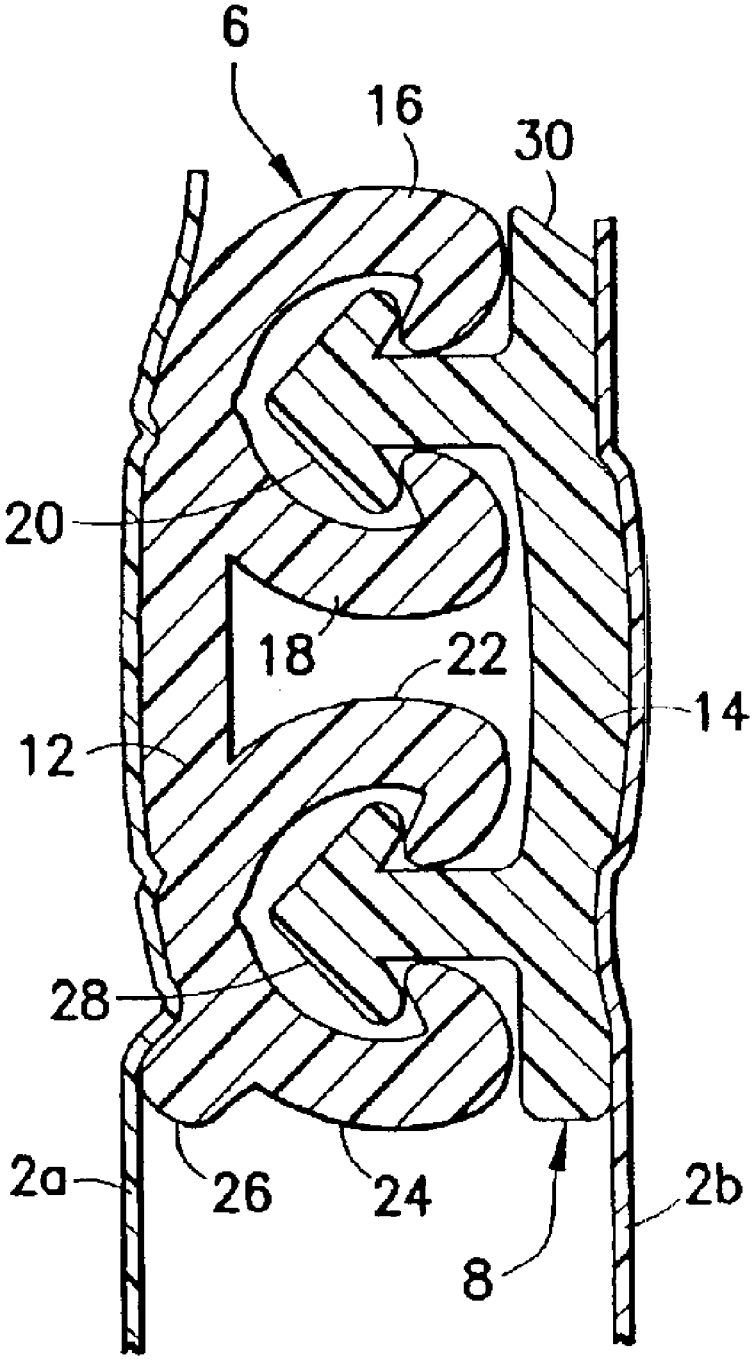
FIG. 3 is a drawing showing a sectioned view of the string zipper incorporated in the assembly depicted in FIG. 2.

One embodiment of a string zipper is seen in FIG. 2 and is shown in greater detail in FIG. 3. Numerals 2*a* and 2*b* indicate opposing walls (made, e.g., of plastic film) of the receptacle. Upper marginal portions of walls 2*a* and 2*b* are joined to the zipper parts 6 and 8, e.g., by heat sealing. The zipper in this example is an extruded plastic structure comprising mutually interlockable profiled zipper parts 6 and 8. Zipper part 8 comprises a base and two generally arrow-shaped rib-like male closure elements or members 20 and 28 projecting from a base 14, and two pairs of hook-shaped gripper jaws connected by a sealing bridge 12. The pairs of gripper jaws form respective complementary female profiles for receiving the male profiles of closure elements 20 and 28. More specifically, jaws 16 and 18 receive and interlock with the male element 20, while jaws 22 and 24 receive and interlock with the male element 28. Alternatively, one zipper part could have one male profile and one female profile, while the other zipper part has one female profile and one male profile, or the respective zipper parts could each have more than two male or female profiles.

The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively, as is best seen in FIG. 3. The upper margins of the bag film may have short free ends that extend beyond the termination points depicted in FIG. 3, provided that the free ends are not so long as to interfere with travel of the slider along the zipper or become entangled with the zipper profiles.

The end face of upper edge 30 of the base 14 that carries the male closure elements 20 and 28 is inclined at about a 45° angle to facilitate loading of the slider onto the zipper from above without snagging on a corner of the upper edge. The bottom edge 8 of the base 14 cooperates with a retaining ledge on the slider (to be described later) to increase the slider-pull-off resistance. For the same purpose, a rib 26 is formed on zipper part 6, the rib 26 cooperating with a retaining ledge on the other side of the slider.

In a typical zipper, the profile of each male member has a stem flanked by shoulders or teeth, and a tip of the profile points toward the opposing female profile, the tip being the point of the male member furthest away from the base of the profiled structure. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile. The groove of each female profile receives the head of a respective male member when the zipper is closed, as best seen in FIG. 3. To open the closed zipper, the zipper parts 6 and 8 are pushed apart with sufficient force by the slider plow to pry the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

In the slider-zipper assembly shown in FIG. 2, the slider 10 for opening or closing the reclosable zipper is generally shaped so that the slider straddles the zipper profiles. The upper margins of the bag walls 2*a* and 2*b*, which are joined to the backs of the zipper parts 6 and 8, are disposed between the respective zipper parts and the respective side walls of the slider.

Figure 4:
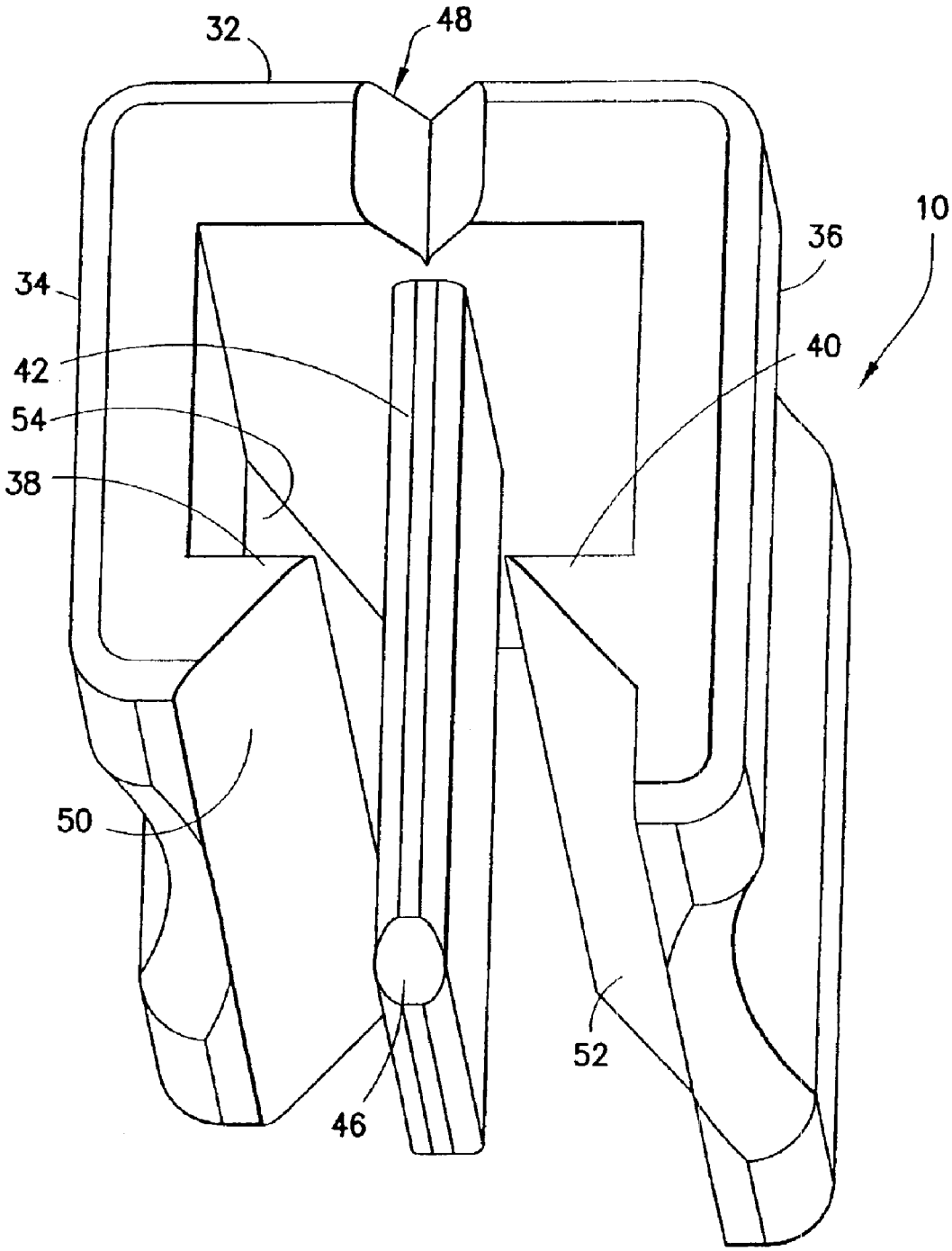
FIG. 4 is a drawing showing an isometric view of the slider incorporated in the assembly depicted in FIG. 2.

FIG. 4 shows an isometric view of the slider 10 incorporated in the assembly depicted in FIG. 2. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces (only one of which, designated by numeral 54, is visible in FIG. 4), which converge toward the closing window of the slider. The inclined surfaces (e.g., 54) funnel or squeeze the zipper parts toward each other, causing the zipper profiles to interlock, as the slider is moved in the closing direction. The sidewalls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each sidewall. The plow is disposed between opposing sections of the zipper parts that pass through the tunnel. The tip of the plow 42 is truncated and has rounded edges and flattened corners 46 at opposing ends for facilitating insertion of the plow between the zipper profiles without snagging during automated slider insertion.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart. The plow 42 divides the closing end of the slider tunnel into respective passages for the separated zipper parts to pass through.

In the embodiment depicted in FIG. 4, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance.

The ledges 38 and 40 further comprise respective inclined bottom surfaces that extend downward and outward from the respective inner edges of the generally horizontal surfaces. The inclined surfaces 50 and 52 are each substantially planar, with the respective planes of these inclined surfaces intersecting at a line inside the tunnel that is parallel to the longitudinal axis of the slider. The inclined surfaces 50 and 52 serve to guide the respective zipper parts 6 and 8 into the slider tunnel during insertion of the slider onto an open section of the zipper. The sliders are typically inserted at spaced intervals onto a string zipper with joined bag film that is intermittently advanced in a machine direction on automated equipment.

As seen in FIG. 4, a V-shaped notch 48 is formed at the opening end of the top wall 32 of the slider. The notch 48 at the closing end of the slider receives a portion of the vertical hump of slider end stop 66 when the slider is in the zipper-open park position. Thus, the notch 48 allows the slider to travel further into the stomped or presealed area. In the case of the zipper-closed park position of the slider, the notch 48 at the opening end of the slider reduces the size of the open area of the zipper between the plow and the end stop. Optionally, a similar notch can be formed in the top wall at the closing end of the slider to increase the length of the open mouth section by the length of the notch.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Improved slider designs are disclosed in U.S. patent application Ser. No. 10/412,438, entitled "Molded Sliders for Actuating Zippers of Reclosable Packages". These improved sliders can be inserted on zippers using the same equipment disclosed herein.

In accordance with the present invention, reclosable packages are manufactured on an automatic production line in which zipper strips are sealed to bag making film and thereafter sliders are inserted at spaced intervals along the zipper-film assembly. To accomplish this, one section of the production line advances the zipper and film continuously, while a subsequent section of the production line advances the zipper-film assembly intermittently and then performs various operations during the dwell time between advancements under the control of a programmable controller. The operations performed continuously during continuous advancement include sealing zipper to film and then trimming excess film at the top of the zipper. The operations performed intermittently during the dwell times include inserting sliders on the zipper strips, forming slider end stops on the zipper, and cutting the zipper-film assembly with a hot knife that both seals and severs to form separate packages. Other operations are performed during intermittent advancement of the zipper-film assembly. For example, during each intermittent advancement, the zipper is pried open by a stationary separator assembly. In addition, downstream of the slider insertion device, a previously inserted slider is held stationary while the zipper-film assembly moves relative thereto, which relative movement of that slider closes a section of the zipper. The transition from continuous advancement of the film to intermittent advancement of the film is accomplished by a conventional dancer assembly. However, a person skilled in the art will readily appreciate that operations performed in the continuous-movement section could also be performed on a section of web being moved intermittently.

Figure 5:
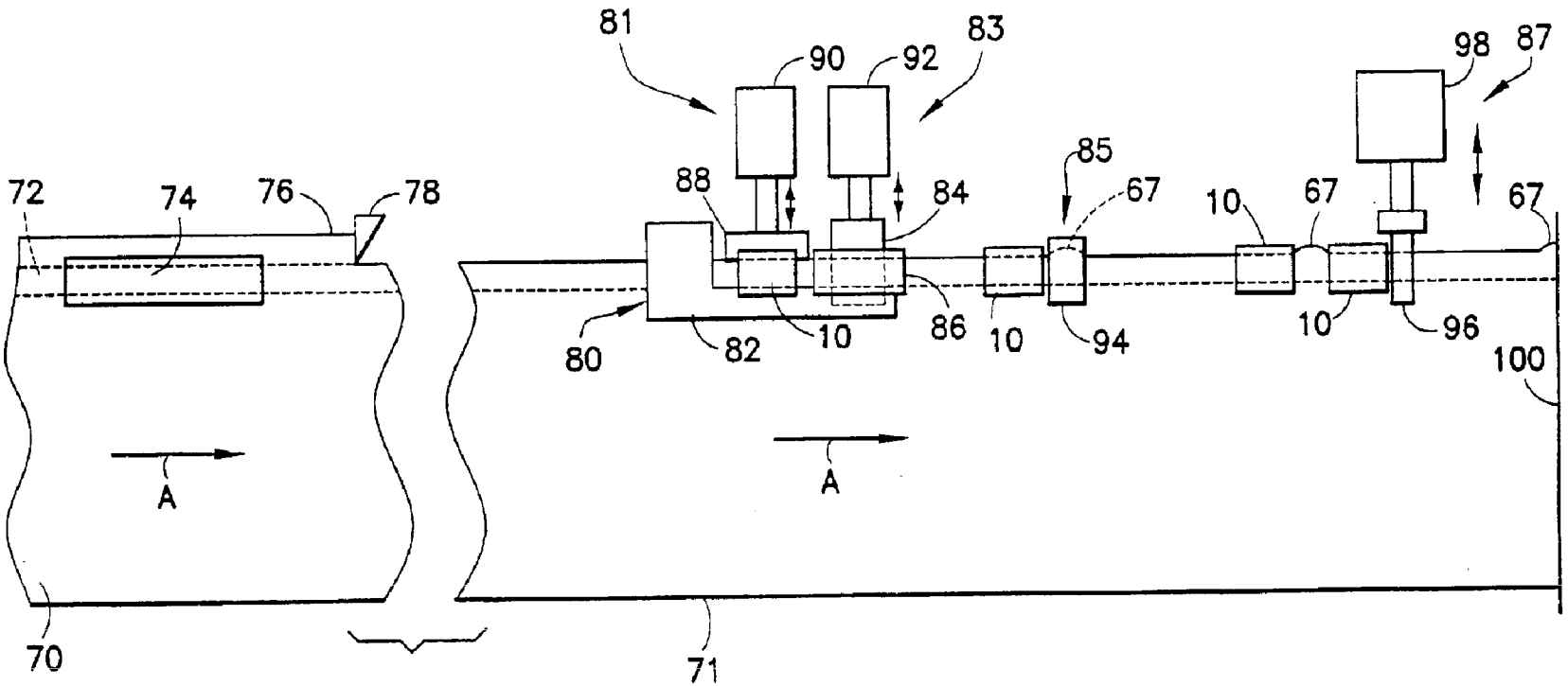
FIG. 5 is a drawing showing a top view of an automated bag making production line in accordance with one embodiment of the present invention. The zipper-film assembly is advanced from left to right, as indicated by arrow A.

A system that performs the foregoing method of manufacture is generally depicted in FIG. 5. The break indicates the transition between the section where the web is advanced continuously (on the left-hand side of the break) and the section where the web is advanced intermittently (on the right-hand side of the break). Numeral 70 designates a web of bag making film that has been folded, while the dashed lines bounding a strip designated by the numeral 72 represents a string zipper. The fold is designated by the numeral 71. The web of film 70 advances in the direction indicated by arrow A. The web of film is unwound from a roll (not shown), passed over a conventional folding board or plow (not shown) and then pulled through the bag making machine by means of conventional guide and drive rollers (not shown). A string zipper 72, comprising a pair of interlocked flangeless zipper strips, is unwound from a reel (not shown) and fed between the upper marginal portions of the opposing sides of the folded web 70. At a zipper sealing station, these marginal portions of the film are joined to the backs of the zipper strips by a pair of mutually opposing conventional heated sealing bars 74 (only one of which is visible in FIG. 5).

The zipper sealing station is conventional apparatus and is described hereinafter only briefly. As the folded web 70 with inserted zipper 72 advances continuously between the opposing sets of sealing bars 74, the respective zipper strips have their backs sealed to the opposing upper marginal portions of the bag making film, thereby continuously attaching incoming sections of the moving string zipper to adjoining sections of the moving web. The sealing is accomplished by electrically heating the sealing bars 74, the heat being conducted through respective endless barrier strips (not shown) made of Teflon or similar material, which circulate on respective sets of rollers (not shown). Each Teflon barrier strips passes between a respective side of the folded web and a respective sealing bar In the gaps between the opposing sealing bars, the web and string zipper are sandwiched between and held together by the Teflon barrier strips, which move with the web and zipper and prevent the bag making film from sticking against the stationary heated sealing bars during conduction heat sealing. The Teflon barrier strips and intervening web and zipper pass through the nips of a series of guide rollers (not shown).

Downstream from the zipper sealing station, the excess is continuously trimmed from the upper marginal portions of the film by a pair of stationary knives 78 (only one of which is visible in FIG. 5). Each knife trims a respective marginal portion of the film that extends beyond the zone of web-to-zipper strip joinder. Trimming removes excess film that could interfere with smooth travel of the slider along the zipper.

The zipper-film assembly then wends its way through a conventional dancer assembly, which converts the upstream continuous advancement of the film into downstream intermittent advancement of the film. In the intermittent advancement phase, the zipper-film assembly is moved one package increment and then stopped for a period of time, i.e., the dwell time. This cycle is repeated.

At the next station in FIG. 5, the slider 10 is inserted onto the zipper-film assembly, the end result being seen in FIG. 2. Referring still to FIG. 5, the slider insertion station comprises three assemblies that cooperate to insert the slider on the zipper while the zipper is being held open on both sides of the zipper portion on which the slider is inserted. Upstream of the slider insertion zone, a separator assembly 80 disengages the zipper strips while the zipper-film assembly is advanced one package length. In the slider insertion zone, a pusher assembly 81 comprises a pusher 88 that pushes a slider 10 onto the zipper. The pusher is extended by actuation of an air cylinder 90. Downstream of the slider insertion zone, the zipper is clamped by a clamping assembly 83 comprising a retractable separator plate 84 that is interposed between the zipper strips of the open zipper section and upper and lower zipper clamps that clamp the zipper strips against the extended separator plate 84. Only the upper zipper clamp 86 is visible in FIG. 5. The separator plate 84 is extended by actuation of an air cylinder 92.

During the same dwell time that a slider is being inserted, a slider end stop structure 67 is being formed on the zipper at an ultrasonic stomping station downstream from the slider insertion device. This slider end stop structure 67 will be bisected later during cutting by a hot knife 100 to form two slider end stops, i.e., the end stop at the zipper fully closed slider park position for one package and the end stop at the zipper fully open slider park position for the next package. The end stop structure 67 is formed by an ultrasonic stomping assembly 85 comprising a horn 94 and an anvil (not shown in FIG. 5). The horn 94 transmits sufficient ultrasound wave energy into that plastic zipper material that the plastic is fused into a structure (e.g., a vertically extending hump) defined by the surfaces of the horn and anvil.

After each dwell time, the entire slider-zipper-film assembly is advanced. During each intermittent advancement, a slider stopper assembly 87 restrains a slider 10 so that a section of zipper is closed. The slider stopper assembly 87 comprises a stopper element 96 coupled to an air cylinder 98. The stopper element 96 is movable from a retracted position to an extended position by actuation of the air cylinder 98. The stopper element 96 is in its extended position when the advancement of the zipper-film assembly begins. In this extended position, the stopper element 96 interferes with the slider and blocks it from advancing with the zipper. This causes a displacement of the slider relative to the zipper in a zipper closing direction, thereby closing a section of zipper. Before the advancement of one package length is completed, the stopper element 96 is retracted, which allows the slider to advance past the retracted stopper element.

During each dwell time, a hot cutting knife 100 (which may comprise a solitary blade or a pair of opposed blades) cuts and forms side seals in the film on both sides of the cut, thereby severing a receptacle (not shown in FIG. 5) from the remainder of the web 70 on the bag making machine.

Figure 6:
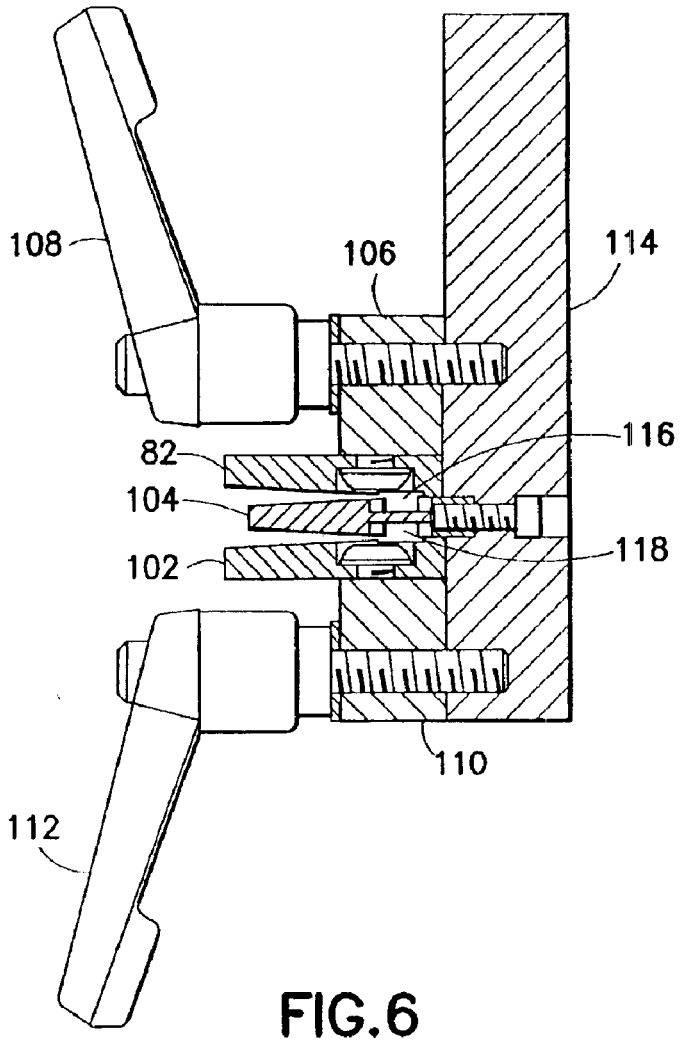
FIG. 6 is a drawing showing a sectional view of a zipper separator assembly incorporated in a slider insertion apparatus in accordance with one embodiment of the present invention. In this example, the zipper-film assembly moves into the page during advancement.
Figure 7:
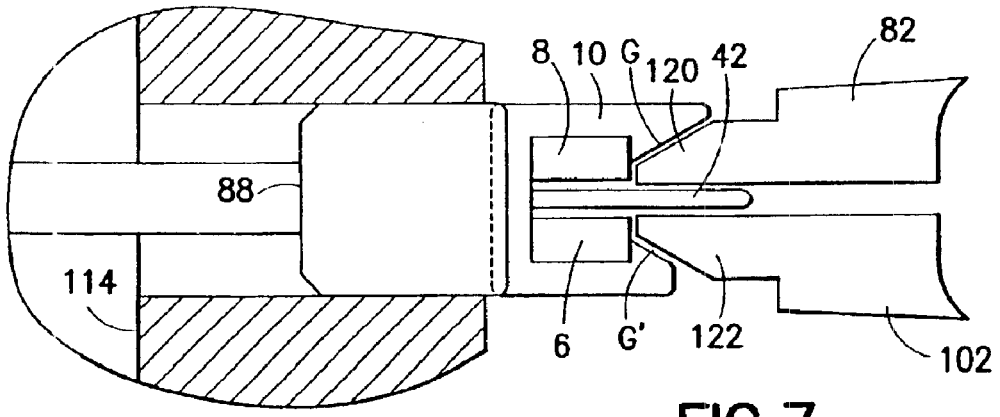
FIG. 7 is a drawing showing a fragmentary, partially sectioned view (on an enlarged scale) of a slider being inserted onto a zipper-film assembly by a pusher assembly incorporated in the slider insertion apparatus in accordance with the disclosed embodiment of the invention. The zipper is symbolically represented by rectangles while the bag film is not shown for clarity.

A slider insertion apparatus in accordance with one embodiment of the invention is shown in FIGS. 6 and 7. Referring to FIG. 7, the pusher 88 is shown in its fully extended position. The pusher 88 is extended and retracted by an air cylinder 90 (see FIG. 5). When the pusher is retracted, the next slider must be automatically fed to a pre-insertion position directly in front of the pusher 88. This is accomplished by a pneumatic slider feeding system.

Systems for transporting sliders to a slider insertion device are disclosed in U.S. patent application Ser. No. 10/106,687 (incorporated by reference herein) filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 2 has one leg (i.e., side wall 36) longer than the other, to wit, an extension 58 of side wall 36 projects to an elevation lower than the bottom edge of the opposing side wall 34. The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

The individual separator, pusher and clamping assemblies of the slider insertion apparatus will now be described in greater detail with reference to FIGS. 6–8.

As seen in FIG. 6, the separator assembly comprises a central splitter plate 104 having a pair of grooves or channels 116 and 118 formed on either side thereof that guide the respective zipper strips (not shown in FIG. 6) as the neck between the grooves pries the moving zipper strips apart. The splitter plate 104 tapers linearly from the neck to the distal edge thereof. The separator assembly further comprises an upper guide 82 (also visible in FIG. 5) and a lower guide 102, which are positioned on opposing sides of the splitter plate 104 with respective gaps therebetween for passage of the respective walls of the film web (not shown in FIG. 6). The upper and lower guides 82 and 102 hold the respective zipper strips in the respective grooves 116 and 118 formed in the splitter plate. Thus, as the zipper-film assembly is pulled through the bag making machine, the splitter plate 104 will pry open successive package-length sections of zipper during successive zipper-film advancements, assuming that each advance is equal to one package length.

To facilitate threading of the zipper strips through the separator assembly, the upper and lower guides 82 and 102 can be pivoted (e.g., about 5 degrees) away from the splitter plate to allow the zipper strips to be passed between the splitter plate and the upper and lower guides. Upper guide 82 is mounted to an upper guide mount 106 that can be pivoted manually upward after the adjustable handle 108 has been untightened, while lower guide 102 is mounted to a lower guide mount 110 that can be pivoted downward (under the force of gravity) after the adjustable handle 112 has been untightened. The splitter plate 104 is independently mounted to a base 114, while the upper and lower guide mounts 106, 110 are pivotably mounted to the base. The upper and lower guide mounts are locked in place by tightening of the respective handles 108 and 112.

The upper and lower guides 82, 102 extend in cantilevered fashion beyond the end of the splitter plate 104, with a gap between the guides in a first zone where the slider is inserted and in a second zone where the zipper is clamped open on the other side of the first zone. The gap in the first zone is shown in FIG. 7, while the gap in the second zone is shown in FIG. 8. As seen in both FIG. 7, the cantilevered blades 122, 120 of guides 102, 82 are disposed to brace the respective zipper parts 6, 8 (indicated symbolically by rectangles without structural detail) against deflection as the slider 10 is pushed onto the zipper. The plow 42 of the inserted slider 10 projects into the gap between the blades 122, 120, as shown in FIG. 7. Likewise the leading section 132 of a retractable separator plate 84 projects into the gap between the blades 120, 122 when the separator plate 84 is fully extended, as shown in FIG. 8. As seen in FIG. 5, the separator plate 84 is extended by actuation of an air cylinder 92. The engagement of the blades 122, 120 with the end 132 of the separator plate 84 stabilizes the latter.

Figure 8:
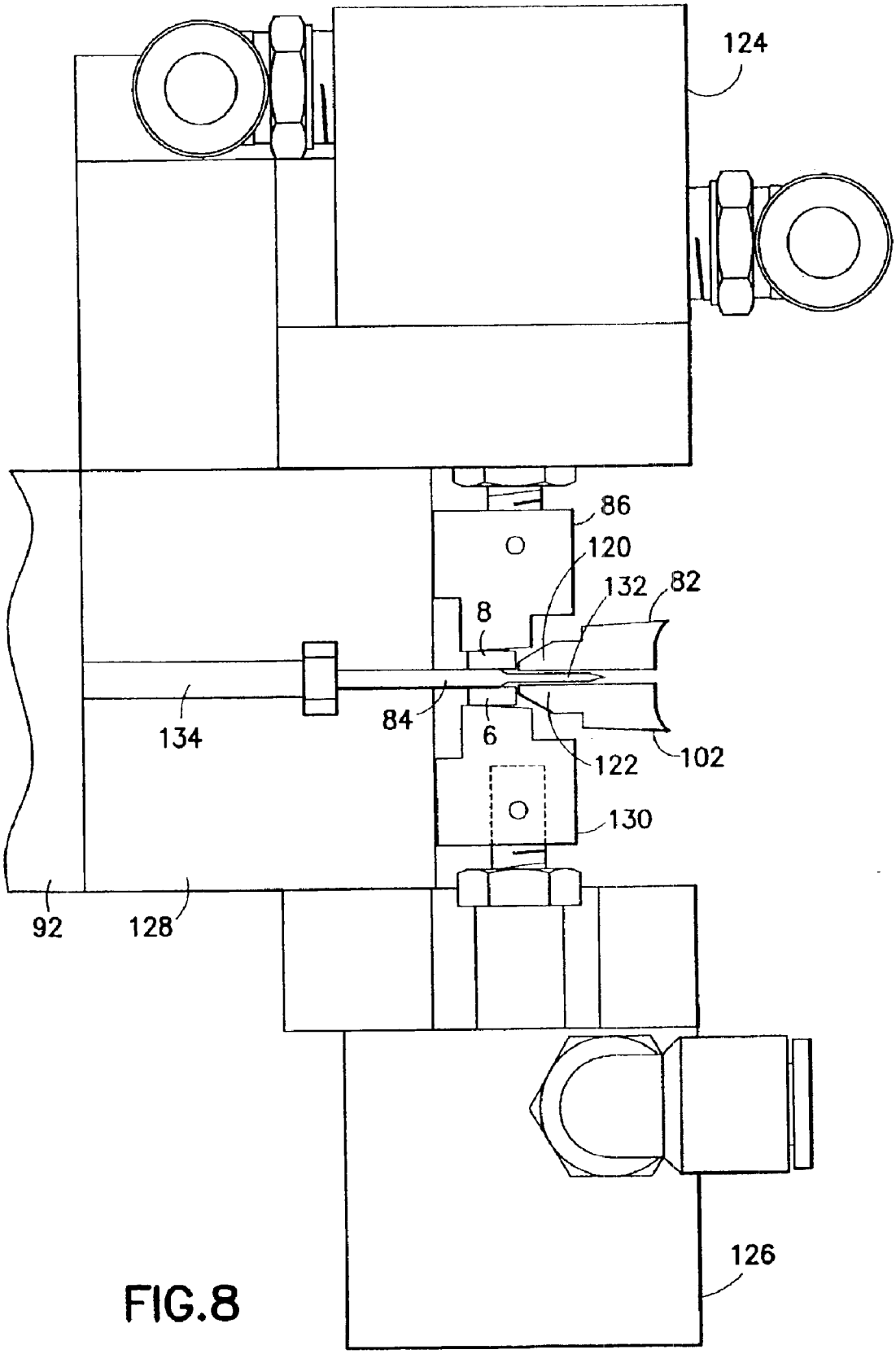
FIG. 8 is a drawing showing a fragmentary, partially sectioned view of a zipper clamping assembly incorporated in the slider insertion apparatus in accordance with the disclosed embodiment of the invention incorporated in the slider insertion apparatus in accordance with the disclosed embodiment of the invention.

Referring to FIG. 8, the separator plate 84 may extend in cantilevered fashion from a rod 134 connected to the piston inside air cylinder 92. FIG. 8 shows that the separator plate 84, when in the fully extended position, is interposed between the zipper strips 6 and 8. Following extension of the separator plate 84, an upper zipper clamp 86 is extended downward by actuation of an air cylinder 124 and a lower zipper clamp 130 is extended upward by actuation of an air cylinder 126. When in their respective fully extended positions, the upper and lower zipper clamps 86 and 130 clamp the respective zipper strips 8 and 6 against the separator plate 84. Thus, the upper and lower guides 82, 102 and the upper and lower zipper clamps 86 and 130 serve to stabilize the zipper during slider insertion. The interposition of the splitter plate 104 (see FIG. 6) and separator plate 84 (see FIG. 8) between the zipper strips 6, 8 upstream and downstream, respectively, of the slider insertion zone means that the zipper is maintained in an open state, with a gap between the zipper strips, in the zone where the slider is inserted. The zipper strips are held in respective positions such that the slider plow 42 enters the gap between the zipper strips (see FIG. 7) and then the slider side walls respectively pass over and under the zipper strips during slider insertion.

The slider 10 is pushed onto the zipper by moving a pusher 88 (seen in FIG. 7) from a retracted position to an extended position. As seen in FIG. 5, the pusher 88 is extended by actuation of an air cylinder 90. FIG. 7 shows the pusher 88 in its fully extended position, with a slider 10 inserted on the zipper strips 6 and 8. The plow 42 is disposed in the gap between the blades 122, 120 of the lower and upper zipper guides 102 and 82. The tips of the blades 122, 120 bear against the zipper strips during slider insertion, thereby bracing the zipper strips against deflection due to the force exerted by the pusher, some of which is transmitted to the zipper via the slider. At the fully extended position of the slider, however, the retaining ledges on the slider side walls latch under the respective zipper strips, as seen in FIG. 7, thereby coupling the slider to the zipper. Thereafter the pusher 88 will be retracted.

Although not shown in FIG. 7 in order to simplify the drawing, it should be understood that respective portions of a folded web of bag making film are joined to the backs of the zipper strips 6 and 8 of the string zipper and pass between the inclined surfaces of the slider side walls and the guide blades 120, 122 at the interstices G and G' respectively. Thus the upper and lower zipper guides 82 and 102 are disposed between the folded web of film.

Figure 9:
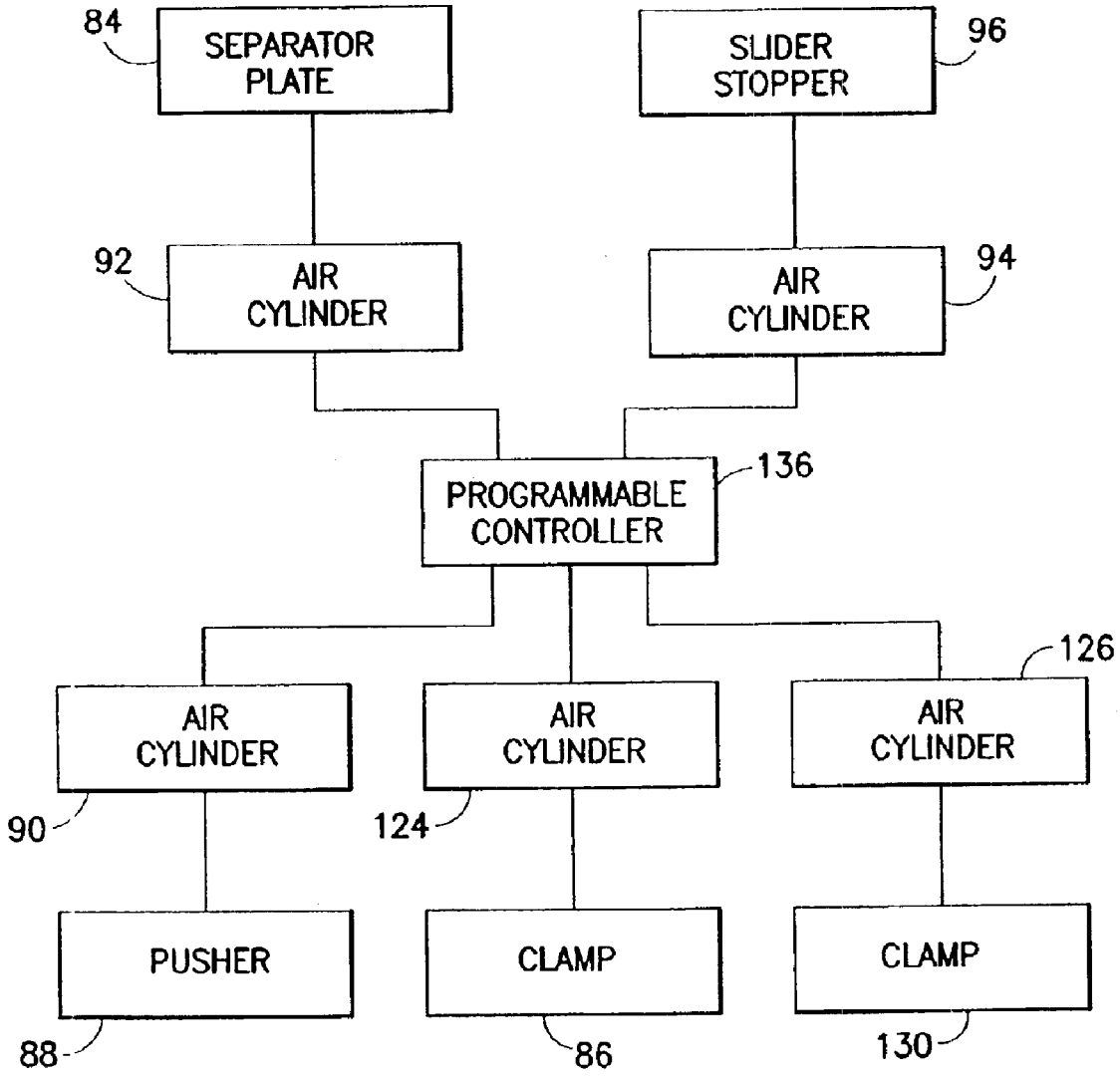
FIG. 9 is a block diagram generally representing programmable control of many of the components of the disclosed embodiment.

As previously mentioned, the extension and retraction of the pusher 88, the upper clamp 86, the lower clamp 142, the separator plate 84 and the slider stopper 96 are achieved in the disclosed embodiment by means of respective air cylinders 90, 124, 126, 92 and 94, generally represented in FIG. 9. Alternatively, hydraulic cylinders could be used. Operation of the cylinders is controlled by a programmable controller 136, which selectively activates the supply of fluid to the cylinders in accordance with an algorithm or logical sequence. The controller may also take the form of a computer or a processor having associated memory that stores a computer program for operating the machine. The controller 136 is programmed to actuate the cylinders in the following order: first, cylinder 92 is actuated to extend the separator plate 84; then the cylinders 124 and 126 are actuated to extend the clamps 86 and 142; and lastly the cylinder 90 is actuated to extend the pusher. The cylinder 94 may be actuated to extend the slider stopper 96 at any time during the dwell time.

A person skilled in the art of machinery design will readily appreciate that displacing means other than cylinders can be used to displace the separator plate, the clamps, the pusher and the slider stopper. Any other known mechanical displacement means can be used. For the sake of illustration, such mechanical displacement devices include rack and pinion arrangements, rotation of the pinion being driven by an electric motor.

Figure 10:
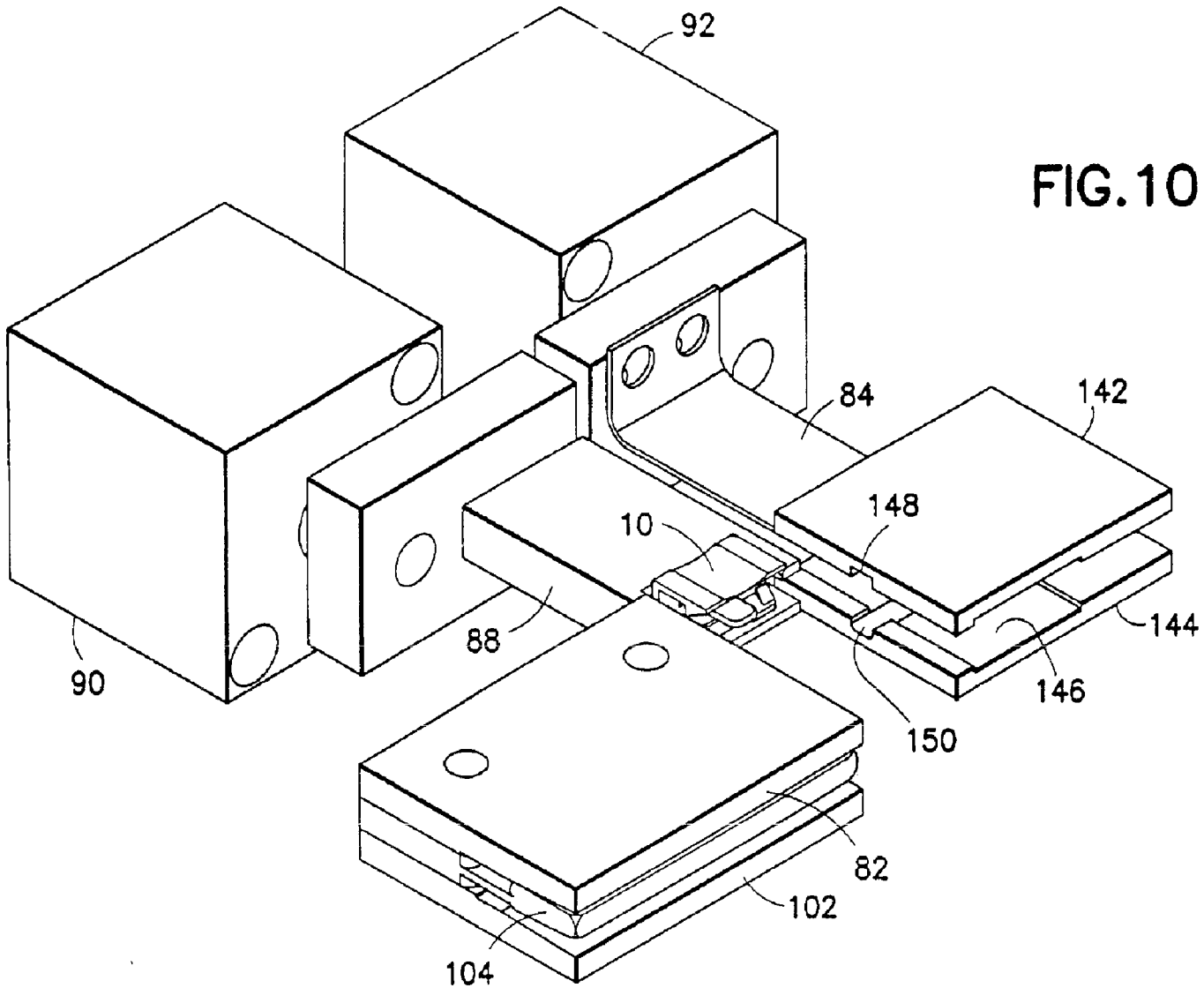
FIG. 10 is a drawing showing an isometric view of a slider insertion apparatus in accordance with an alternative embodiment of the invention.

An alternative embodiment of a slider insertion apparatus is generally depicted in FIG. 10. One difference between the structure shown in FIG. 10 and the structure of FIGS. 6–8 is that the zipper guides 82 and 102 of the separator assembly do not have cantilevered extensions for bracing the zipper during slider insertion and for stabilizing the distal end of the separator plate 84. Instead, a pair of clamp plates 142 and 144 having respective grooves 148 and 150 for receiving the respective zipper strips are provided. One side wall of groove 148 braces one zipper strip, while one side wall of groove 150 braces the other zipper strip during slider insertion. Relieved areas 146 are provided on both clamping plates to provide clearance for the separator plate 84 when the latter is fully extended and the zipper-film assembly is clamped.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc.

What is claimed is:

1. A method of manufacture comprising the following steps:

(a) joining a first portion of a length of film material to a back side of a length of a first flangeless zipper strip having a first closure profile on its front side;

(b) joining a second portion of said length of film material to a back side of a length of a second flangeless zipper strip having a second closure profile on its front side, said first and second closure profiles of said respective lengths of said first and second zipper strips being interlockable to form a length of string zipper assembly; and (c) after said joining steps, loading a slider comprising a plow onto a first section of said length of string zipper assembly with said plow being inserted between said first and second flangeless zipper strips, respective portions of said first and second portions of said length of film material being respectively disposed between said slider and said string zipper assembly after said slider has been loaded.

2. The method as recited in claim 1, further comprising the step of trimming a marginal portion of said length of film material that extends beyond said first portion of said length of film material.

3. The method as recited in claim 1, further comprising the step of opening at least said first section of said length of string zipper assembly, wherein said length of string zipper assembly is closed during said joining steps and said first section is open during said slider loading step.

4. The method as recited in claim 3, wherein said opening step comprises the step of pulling said string zipper assembly relative to a stationary plate while said plate is disposed between adjacent portions of said first and second flangeless zipper strips, said string zipper assembly being closed upstream of said plate and being open downstream of said plate.

5. The method as recited in claim 1, further comprising the step of inserting a retractable plate between said first and second flangeless zipper strips in a second section of said length of string zipper assembly, said slider loading step being performed while said inserted plate is disposed between said first and second flangeless zipper strips in said second section.

6. The method as recited in claim 5, further comprising the step of clamping said first and second flangeless zipper strips against said plate in said second section of said string zipper assembly during said loading step.

7. The method as recited in claim 1, further comprising the steps of maintaining second and third sections of said length of string zipper assembly in an open state while said slider is being loading onto said first section, said second and third sections being located on opposite sides of said first section.

8. The method as recited in claim 1, wherein said length of film material is advancing continuously during said joining steps and is not advancing during said slider loading step.

9. The method as recited in claim 1, further comprising the step of folding said length of film material along a line that places said first and second portions of said length of film material in mutually confronting positions.

10. The method as recited in claim 1, further comprising the step of causing said loaded slider to displace relative to said length of string zipper assembly in a closing direction.

11. A method of manufacture comprising the following steps:

(a) joining a first portion of a length of film material to a length of a first zipper strip having a first closure profile;

(b) joining a second portion of said length of film material to a length of a second zipper strip having a second closure profile, said first and second closure profiles of said respective lengths of said first and second zipper strips being interlockable to form a length of zipper assembly;

(c) inserting a retractable plate between said first and second zipper strips in a first section of said length of zipper assembly; and (d) after steps (a) through (c) have been performed, loading a slider comprising a plow onto a second section of said length of zipper assembly with said plow being inserted between said first and second zipper strips, wherein said second section does not overlap with said first section.

12. The method as recited in claim 11, further comprising the step of clamping said first and second zipper strips against said plate after said inserting step and before said loading step.

13. The method as recited in claim 11, wherein said length of film material is advancing continuously during said joining steps and is not advancing during said slider loading step.

14. A method of manufacture comprising the following steps:

(a) joining a first portion of a length of film material to a length of a first zipper strip having a first closure profile;

(b) joining a second portion of said length of film material to a length of a second zipper strip having a second closure profile, said first and second closure profiles of said respective lengths of said first and second zipper strips being interlockable to form a length of zipper assembly;

(c) inserting a retractable plate between said first and second zipper strips in a first section of said length of zipper assembly; and (d) maintaining second and third sections of said length of zipper assembly in an open state while said slider is being loading onto said first section, said second and third sections being located on opposite sides of said first section.

15. The method as recited in claim 14, wherein said length of film material is advancing continuously during said joining steps and is not advancing during said slider loading step.

* * * * *